US009217959B1

(12) United States Patent
Kawabata

(10) Patent No.: US 9,217,959 B1
(45) Date of Patent: Dec. 22, 2015

(54) IMAGE FORMING APPARATUS

(71) Applicant: Konica Minolta, Inc., Tokyo (JP)

(72) Inventor: Shinichi Kawabata, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/725,582

(22) Filed: May 29, 2015

(30) Foreign Application Priority Data

Jun. 3, 2014 (JP) ..... 2014-114960

(51) Int. Cl.
*G03G 15/16* (2006.01)

(52) U.S. Cl.
CPC ..... *G03G 15/1605* (2013.01)

(58) Field of Classification Search
CPC ..... G03G 15/0189; G03G 15/0136; G03G 15/14–15/1695; G03G 2215/0193
See application file for complete search history.

(56) References Cited

U.S. PATENT DOCUMENTS 5,701,569 A * 12/1997 Kanazawa ..... G03G 15/1675 399/308
5,822,666 A * 10/1998 Haneda ..... G03G 15/161 399/101
2007/0147876 A1* 6/2007 Moro ..... G03G 15/161 399/101
2007/0189802 A1* 8/2007 Maeda ..... G03G 15/161 399/101
2007/0201897 A1* 8/2007 Maeda ..... G03G 15/161 399/101
2008/0145089 A1* 6/2008 Takahashi ..... G03G 15/50 399/74
2009/0123201 A1* 5/2009 Ehara ..... G03G 15/161 399/328
2009/0169233 A1* 7/2009 Hayakawa ..... G03G 15/16 399/74
2011/0033212 A1* 2/2011 Suzuki ..... G03G 15/161 399/296
2011/0097104 A1* 4/2011 Sueoka ..... G03G 15/161 399/101
2012/0020686 A1* 1/2012 Hirai ..... G03G 15/161 399/49
2012/0107013 A1* 5/2012 Kaneyama ..... G03G 15/161 399/101
2012/0114367 A1* 5/2012 Yagata ..... G03G 15/161 399/101
2012/0114368 A1* 5/2012 Koide ..... G03G 15/161 399/101
2012/0114370 A1* 5/2012 Yamada ..... G03G 15/0131 399/101
2012/0275804 A1* 11/2012 Watanabe ..... G03G 15/0136 399/39
2012/0308246 A1* 12/2012 Okamoto ..... G03G 15/0189 399/49
2012/0321336 A1* 12/2012 Ogiyama ..... G03G 15/0189 399/88
2013/0084085 A1* 4/2013 Tani ..... G03G 15/0189 399/13
2013/0223872 A1* 8/2013 Aiba ..... G03G 21/0011 399/101
2013/0287428 A1* 10/2013 Yamana ..... G03G 15/161 399/101
2014/0270819 A1* 9/2014 Wada ..... G03G 15/553 399/29
2015/0177673 A1* 6/2015 Suzuki ..... G03G 21/0011 399/101

FOREIGN PATENT DOCUMENTS

JP 2010190959 A 9/2010

* cited by examiner

*Primary Examiner* — Clayton E Laballe
*Assistant Examiner* — Ruifeng Pu
(74) *Attorney, Agent, or Firm* — Lucas & Mercanti, LLP

(57) ABSTRACT

An image forming apparatus includes a toner receiving member, and a toner receiver driving section. The toner receiving member supplements toner of a correction patch that falls from and spatters from an intermediate transfer belt. A toner receiver driving section movably supports the toner receiving member. A control section inserts the toner receiving member between a sheet-side transfer roller and the intermediate transfer belt when the sheet-side transfer roller is spaced apart from the intermediate transfer belt.

6 Claims, 10 Drawing Sheets

IMAGE FORMING APPARATUS

CROSS REFERENCE TO RELATED APPLICATION

This Application claims the priority of Japanese Patent Application No. 2014-114960 filed on Jun. 3, 2014, the contents of which is incorporated herein by reference.

BACKGROUND OF THE INVENTION

1. Field of the Invention

The present invention relates to an image forming apparatus applied to a copy machine, a printer, a facsimile device, or the like, and in particular, to an image forming apparatus that detects a correction patch to perform image stabilizing processing.

2. Description of the Related Art

There has been widely used an electrophotographic image forming apparatus in which a toner image formed on a photoreceptor is transferred to a sheet or other transfer materials via a transfer section such as an intermediate transfer belt, the sheet having the toner image transferred thereon is heated and pressurized in a fixing section, and the toner image is fixed on the sheet.

The fixing section used in such an image forming apparatus includes, for example, a fixing member constituted of a heating roller, and a pressurizing member disposed in a position facing the fixing member and including a counter roller that is pressed against the fixing member side while rotating. In addition, the sheet that carries an unfixed toner image passes through a nip portion between the fixing member and the pressurizing member, whereby the toner image is fixed on the sheet.

Conventionally, there is known an image forming apparatus in which a sensor for image stabilization is disposed on the downstream side of a transfer section on an intermediate transfer belt, and image stabilizing processing is performed, in order to stabilize quality of images. This image forming apparatus creates a correction patch formed by toner on the intermediate transfer belt, and detects this correction patch with the sensor for image stabilization, thereby correcting imaging conditions for forming images. In addition, when the correction patch passes through between the intermediate transfer belt and a transfer roller (transfer nip portion), the transfer roller is spaced apart from the intermediate transfer belt in order to prevent a part of the toner of the correction patch from adhering to the transfer roller.

Furthermore, an image forming apparatus described in Patent Literature 1 proposes a technique of making a system speed of image stabilizing processing slower than that of image forming processing in performing the image stabilizing processing, in order to prevent toner from spattering.

RELATED ART DOCUMENTS

Patent Document

Patent Literature 1: Japanese Patent Laid-Open Publication No. 2010-190959

DISCLOSURE OF THE INVENTION

Problems to be Solved by the Invention

However, even if the system speed is slowed down as with the image forming apparatus described in Patent Literature 1, there is a possibility that toner spatters from the intermediate transfer belt due to a centrifugal force generated at a curved portion of the intermediate transfer belt formed by the transfer roller when the correction patch passes through the curved portion. In addition, toner of the correction patch possibly falls from the intermediate transfer belt due to its own weight. As a result, the image forming apparatus described in Patent Literature 1 has a problem in which the transfer roller becomes stained due to the toner falling from or spattering from the intermediate transfer belt.

Furthermore, in recent years, there has been proposed a technique using a recording medium wound into a roll shape as a recording medium (hereinafter, referred to as a roll sheet). In the case where a roll sheet continuously extending in the sheet conveying direction is used as described above, the roll sheet exists in the apparatus even during image stabilizing processing. Therefore, there is a problem in which the roll sheet becomes stained due to the toner falling from and spattering from the intermediate transfer belt.

The present invention has been made in view of the existing problems described above, and an object of the present invention is to provide an image forming apparatus that can prevent a sheet, transfer roller, and the like from becoming stained due to the toner falling from and spattering from an intermediate transfer belt during image stabilizing processing.

SUMMARY OF THE INVENTION

In order to solve the problems described above and achieve an object of the present invention, the present invention includes: an intermediate transfer belt formed into an endless shape; a belt-side transfer roller; a sensor for image stabilization; a sheet-side transfer roller; a toner receiving member; a toner receiver driving section; and a control section.

The intermediate transfer belt is stretched around the belt-side transfer roller, and is rotatably supported by the belt-side transfer roller. The sensor for image stabilization is disposed on the upstream side of the belt-side transfer roller for the intermediate transfer belt in the rotational direction of the intermediate transfer belt. Furthermore, the sensor for image stabilization detects a correction patch for image stabilizing processing, the correction patch being formed on the intermediate transfer belt. The sheet-side transfer roller is disposed so as to face the belt-side transfer roller with the intermediate transfer belt being disposed therebetween, and is constituted so as to be able to be in contact with the intermediate transfer belt and to be spaced apart from the intermediate transfer belt. The toner receiving member supplements toner of the correction patch falling from or spattering from the intermediate transfer belt. The toner receiver driving section movably supports the toner receiving member. The control section causes the toner receiving member to be spaced apart from the sheet-side transfer roller and the intermediate transfer belt when the sheet-side transfer roller is brought into contact with the intermediate transfer belt, and inserts the toner receiving member between the sheet-side transfer roller and the intermediate transfer belt when the sheet-side transfer roller is spaced apart from the intermediate transfer belt.

BRIEF DESCRIPTION OF THE DRAWINGS

FIG. 5A is an explanatory view illustrating a state of the image forming apparatus during the image forming processing and during a normal operation; FIG. 5B is an explanatory view illustrating a state where a sheet-side transfer roller is spaced apart; and FIG. 5C is an explanatory view illustrating a state of the image forming apparatus during the image stabilizing processing.

DESCRIPTION OF THE PREFERRED EMBODIMENTS

Hereinafter, an embodiment for carrying out an image forming apparatus according to the present invention will be explained with reference to FIG. 1 to FIG. 12. Note that the same reference signs are attached to portions common to these drawings. In addition, the present invention is not limited to the following forms.

1. Example of First Embodiment

1-1. Configuration of Image Forming System

First, an image forming system having an image forming apparatus according to an example of a first embodiment (hereinafter, referred to as "this example") of the present invention will be explained with reference to FIG. 1 to FIG. 6.

Figure 1:
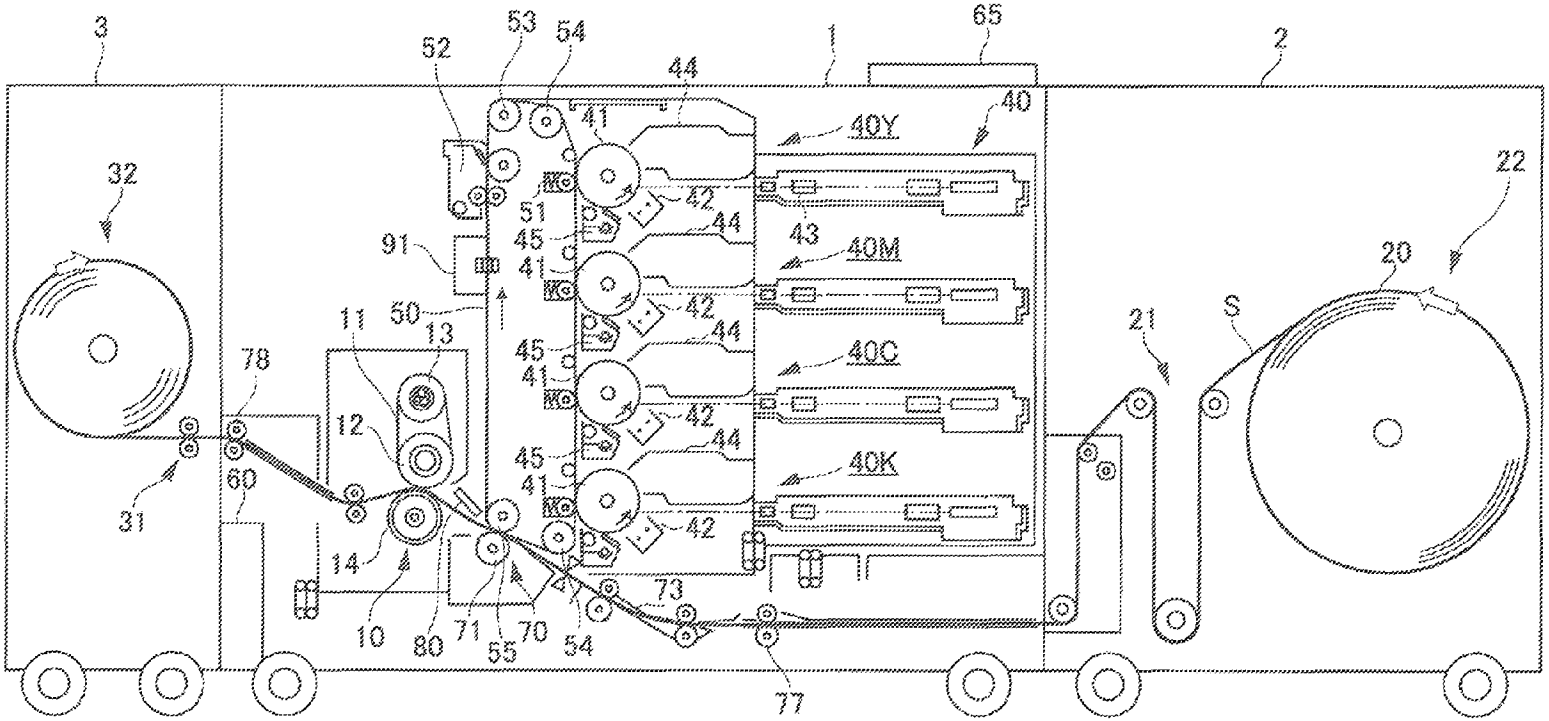
FIG. 1 is a schematic configuration diagram of an image forming system having an image forming apparatus according to an example of a first embodiment of the present invention.

FIG. 1 is a schematic configuration diagram of an image forming system 100.

[Image Forming System]

As illustrated in FIG. 1, the image forming system 100 includes an image forming apparatus 1, a sheet feeding device 2 that feeds a roll sheet S to the image forming apparatus 1, and a sheet ejection device 3 that winds the roll sheet S ejected from the image forming apparatus 1.

[Image Forming Apparatus]

Next, the image forming apparatus 1 will be explained. The image forming apparatus 1 is an apparatus for forming an image on the roll sheet S by using an electrophotographic system, and is a tandem-type color image forming apparatus, in which toners of four colors, yellow (Y), magenta (M), cyan (C), and black (Bk), are superposed.

As illustrated in FIG. 1, the image forming apparatus 1 according to the present embodiment includes a conveying section 73, an image forming section 40, an intermediate transfer belt 50, a secondary transfer section 70, a fixing section 10, a toner receiving mechanism 80, an operation display section 65, and a control section 60.

The conveying section 73 is constituted of a plurality of conveying rollers 77 disposed on the upstream side of the secondary transfer section 70, and continuously conveys the roll sheet S conveyed from the sheet feeding device 2 to the secondary transfer section 70 being a transfer position.

The image forming section 40 includes four image forming units 40Y, 40M, 40C, and 40K in order to forma toner image of each color of yellow (Y), magenta (M), cyan (C), and black (Bk).

The first image forming unit 40Y forms the toner image of yellow, and the second image forming unit 40M forms the toner image of magenta. In addition, the third image forming unit 40C forms the toner image of cyan, and the fourth image forming unit 40K forms the toner image of black. These four image forming units 40Y, 40M, 40C, and 40K have the same configuration, and thus the first image forming unit 40Y will be explained as a representative image forming unit.

The first image forming unit 40Y includes a drum-shaped photoreceptor 41, and further includes a charging section 42, an exposure section 43, a developing section 44, and a cleaning device 45 which are disposed around the photoreceptor 41. The photoreceptor 41 is rotated by a driving motor (not illustrated) in a counterclockwise direction. The charging section 42 gives an electric charge to the photoreceptor 41 to uniformly charge the surface of the photoreceptor 41. The exposure section 43 performs exposure and scanning to the surface of the photoreceptor 41 on the basis of image data transmitted from the outside, and forms an electrostatic latent image on the photoreceptor 41.

The developing section 44 causes yellow toner to adhere onto the electrostatic latent image formed on the photoreceptor 41. With this operation, a toner image of yellow is formed on the surface of the photoreceptor 41. Note that the developing section 44 for the second image forming unit 40M causes magenta toner to adhere onto the photoreceptor 41, and the developing section 44 for the third image forming unit 40C causes cyan toner to adhere onto the photoreceptor 41. In addition, the developing section 44 for the fourth image forming unit 40K causes black toner to adhere onto the photoreceptor 41.

The toner adhering onto the photoreceptor 41 is transferred to the intermediate transfer belt 50. The cleaning device 45 removes the toner remaining on the surface of the photoreceptor 41 after the toner is transferred to the intermediate transfer belt 50.

The intermediate transfer belt 50 is formed into an endless shape, and is stretched over a driving roller 53, a belt-side transfer roller 55, and a plurality of driven rollers 54. Additionally, the intermediate transfer belt 50 is rotatably supported by the driving roller 53, the belt-side transfer roller 55, and the plurality of driven rollers 54.

Furthermore, the belt-side transfer roller 55 is disposed below the intermediate transfer belt 50 in the vertical direction. In addition, the intermediate transfer belt 50 rotates by the driving roller 53, the belt-side transfer roller 55, and the plurality of driven rollers 54 in a clockwise direction, which is the opposite direction to rotation of the photoreceptor 41. A primary transfer section 51 is provided in a position in the intermediate transfer belt 50 facing the photoreceptor 41 of each of the image forming units 40Y, 40M, 40C, and 40K. This primary transfer section 51 applies a polarity opposite to that of the toner, to the intermediate transfer belt 50 to thereby transfer the toner image formed on the photoreceptor 41 to the intermediate transfer belt 50.

Furthermore, the toner images formed by the four image forming units 40Y, 40M, 40C, and 40K are sequentially transferred to the surface of the intermediate transfer belt 50 by the rotation of the intermediate transfer belt 50. With this configuration, toner images with yellow, magenta, cyan, and black are superposed on the intermediate transfer belt 50, whereby a color image is formed.

The secondary transfer section 70 is disposed in the vicinity of the intermediate transfer belt 50 and on the downstream side of the conveying section 73. The secondary transfer section 70 includes the belt-side transfer roller 55 over which the intermediate transfer belt 50 is stretched, and a sheet-side transfer roller 71 that is pressed against the belt-side transfer roller 55 side with the intermediate transfer belt 50 being disposed therebetween. These belt-side transfer roller 55 and sheet-side transfer roller 71 constitute a secondary transfer roller. The sheet-side transfer roller 71 is disposed below the belt-side transfer roller 55 in the vertical direction in a position facing the belt-side transfer roller 55 with the intermediate transfer belt 50 being disposed therebetween. Furthermore, the sheet-side transfer roller 71 is constituted so as to be able to be in contact with the intermediate transfer belt 50 and to be spaced apart from the intermediate transfer belt 50.

When the color toner image formed on the intermediate transfer belt 50 is transferred to the roll sheet S, the secondary transfer section 70 brings the sheet-side transfer roller 71 into contact with a portion of the intermediate transfer belt 50, where the belt-side transfer roller 55 is disposed. With this configuration, a transfer nip portion 75 is formed at a portion where the intermediate transfer belt 50 and the sheet-side transfer roller 71 are brought into contact with each other (see FIG. 2). In addition, the roll sheet S passes through the transfer nip portion 75, and thus the secondary transfer section 70 transfers, onto the roll sheet S, the color toner image formed on the intermediate transfer belt 50. A belt cleaning portion 52 removes the toner remaining on the surface of the intermediate transfer belt 50 after the color toner image is transferred to the roll sheet S.

Furthermore, when image stabilizing processing is performed, the secondary transfer section 70 causes the sheet-side transfer roller 71 to be spaced apart from the intermediate transfer belt 50.

The belt cleaning portion 52 is disposed on the downstream side of the secondary transfer section 70 in the rotational direction of the intermediate transfer belt 50. The belt cleaning portion 52 removes toner remaining on the surface of the intermediate transfer belt 50 after the toner image is transferred to the roll sheet S.

Moreover, a sensor 91 for image stabilization is disposed between the belt cleaning portion 52 of the intermediate transfer belt 50 and the secondary transfer section 70. The sensor 91 for image stabilization detects a correction patch formed on the intermediate transfer belt 50 during image stabilizing processing.

Furthermore, the fixing section 10 is disposed on an ejection side of the roll sheet S in the secondary transfer section 70. The fixing section 10 includes a fixing belt 11, and a pressurizing roller 14 serving as a pressurizing member. The fixing belt 11 is constituted of an endless-shaped elastic member, and is supported by and stretched over a fixing roller 12 serving as a driving roller and a heating roller 13 serving as a driven roller.

In addition, a fixing nip portion is formed at a portion where the fixing belt 11 and the pressurizing roller 14 are brought into contact with each other. The roll sheet S carrying the toner image passes through the fixing nip portion of the fixing section 10, and thus toner melts with the fixing belt 11 and the pressurizing roller 14 which are controlled so as to have a predetermined temperature, whereby the toner is fixed to the roll sheet S.

Moreover, a pair of sheet ejecting rollers 78 is disposed on the downstream side of the fixing section 10 in the sheet conveying direction. The pair of sheet ejecting rollers 78 continuously conveys roll sheet S conveyed from the fixing section 10, to the sheet ejection device 3.

A toner receiving mechanism 80 is disposed on the downstream side of the transfer nip portion 75 of the secondary transfer section 70 in the sheet conveying direction and between the secondary transfer section 70 and the fixing section 10. Note that the detailed configuration of the toner receiving mechanism 80 will be described later.

The operation display section 65 is a touch panel including a display such as a liquid crystal display device (LCD) and an organic ELD (electro luminescence display). This operation display section 65 displays, for example, an instruction menu for a user, information on image data acquired, or the like. In addition, the operation display section 65 includes a plurality of keys, and serves as an input section that receives input of data such as various instructions, letters, and numerals made through key operations by the user.

Figure 4:
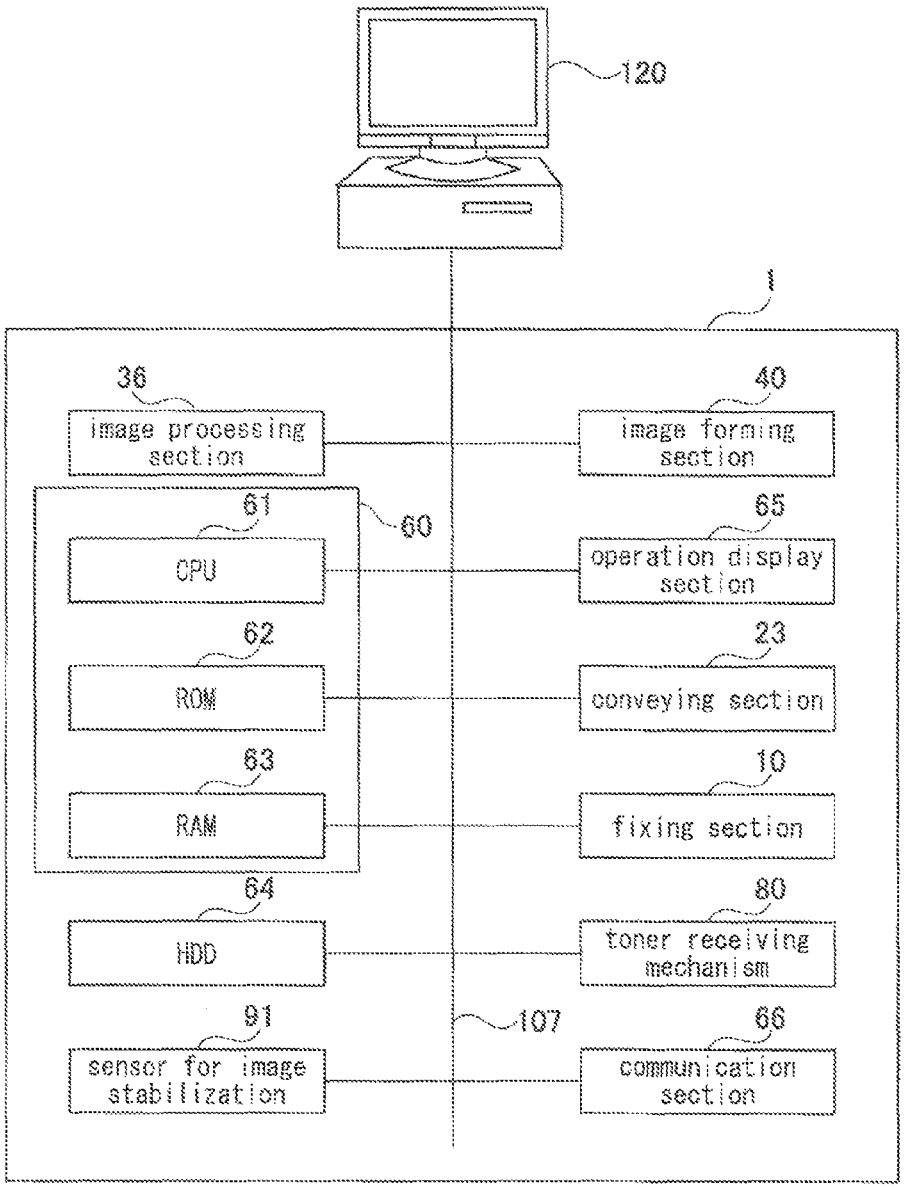
FIG. 4 is a block diagram illustrating a configuration of a control system of the image forming apparatus according to the example of the first embodiment of the present invention.

The control section 60 operates each section in the image forming apparatus 1 in accordance with instructions from the operation display section 65 or a personal computer 120 externally connected (see FIG. 4).

[Sheet Feeding Device and Sheet Ejection Device]

Next, the sheet feeding device 2 and the sheet ejection device 3 will be explained. The sheet feeding device 2 includes a roll-sheet placement section 22, and a conveying section 21. The roll-sheet placement section 22 is provided with a desired roll sheet body 20 in a rotatable manner. In addition, the conveying section 21 is constituted of a plurality of conveying rollers, and conveys the roll sheet S ejected from the roll-sheet placement section 22 to the image forming apparatus 1 side.

The sheet ejection device 3 includes a conveying section 31, and a winding section 32. The conveying section 31 is constituted of a plurality of conveying rollers, and conveys the roll sheet S ejected to the sheet ejection device 3 to the winding section 32 side. The winding section 32 winds the conveyed roll sheet S into a roll shape.

[Toner Receiving Mechanism]

Subsequently, the configuration of the toner receiving mechanism 80 will be explained with reference to FIG. 2 and FIG. 3.

Figure 2:
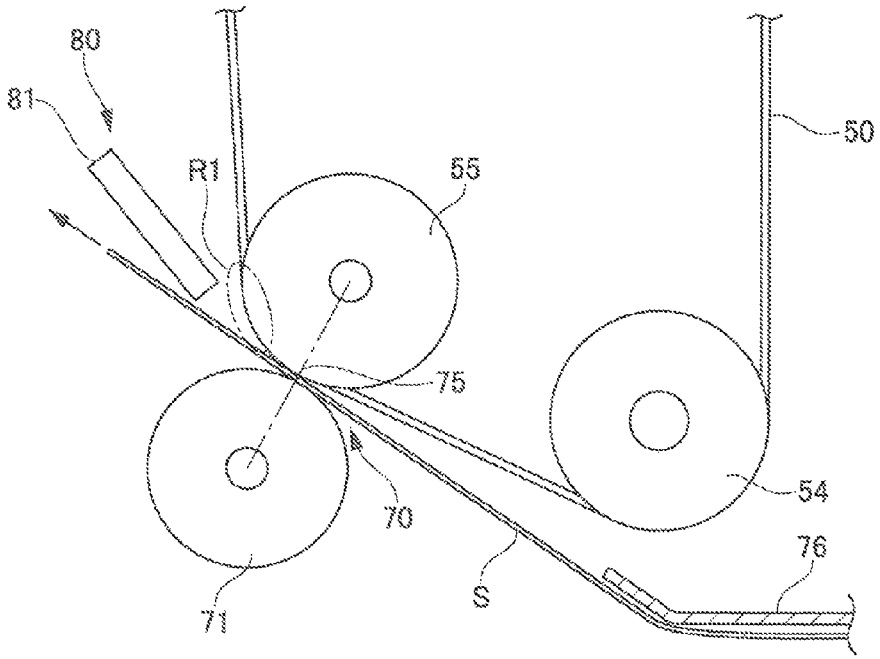
FIG. 2 is a schematic configuration diagram of the image forming apparatus according to the example of the first embodiment of the present invention, shown by enlarging a toner receiving mechanism.
Figure 3:
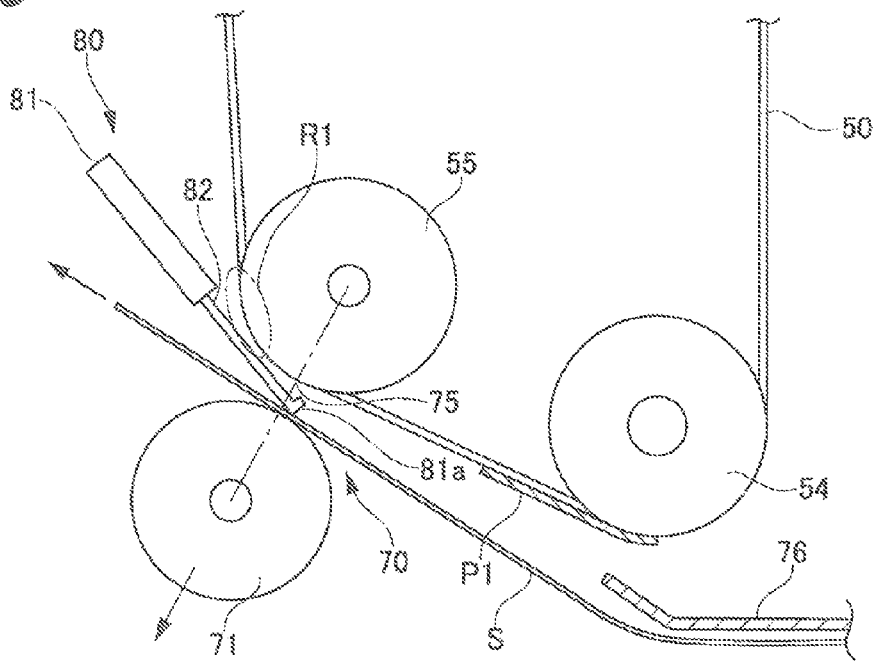
FIG. 3 is a schematic configuration diagram of the image forming apparatus according to the example of the first embodiment of the present invention, shown by enlarging the toner receiving mechanism during image stabilizing processing.

FIG. 2 and FIG. 3 are schematic configuration diagrams illustrating the toner receiving mechanism 80 and the secondary transfer section 70 in an enlarged manner.

As illustrated in FIG. 2 and FIG. 3, the toner receiving mechanism 80 includes a toner receiving member 82 and a toner receiver driving section 81 that accommodates the toner receiving member 82. The toner receiving member 82 is formed substantially into a plate-like shape. In addition, the widthwise length of the toner receiving member 82 is set so as to be substantially equal to or slightly longer than the widthwise length of the roll sheet S. Furthermore, the toner receiving member 82 is movably supported by the toner receiver driving section 81.

The toner receiver driving section 81 is constituted of, for example, a solenoid actuator, a gear, a motor and the like.

In the case where the sheet-side transfer roller 71 is in contact with the intermediate transfer belt 50 as illustrated in FIG. 2, the toner receiving member 82 is spaced apart from the intermediate transfer belt 50, the belt-side transfer roller 55, and the sheet-side transfer roller 71, and is accommodated in the toner receiver driving section 81. Therefore, it is possible to prevent the toner receiving member 82 from interfering with the intermediate transfer belt 50, the belt-side transfer roller 55, and the sheet-side transfer roller 71 at the time of transfer processing of the toner image to the roll sheet S at the transfer nip portion 75.

Furthermore, in the case where the sheet-side transfer roller 71 is spaced apart from the intermediate transfer belt 50 as illustrated in FIG. 3, the toner receiving member 82 is inserted between the intermediate transfer belt 50 and the sheet-side transfer roller 71 from the downstream side toward the upstream side of the transfer nip portion 75 in the sheet conveying direction. At this time, the toner receiving member 82 is interposed above the roll sheet S in the vertical direction and between the intermediate transfer belt 50 and the roll sheet S.

With this configuration, the toner receiving member 82 can supplement toner falling from and spattering from the intermediate transfer belt 50, with toner of the correction patch P1 formed on the intermediate transfer belt 50. This makes it possible to prevent the sheet-side transfer roller 71 or the roll sheet S from becoming stained due to the toner falling and spattering.

Here, a guide plate 76 that guides the roll sheet is provided on the upstream side of the transfer nip portion 75 in the sheet conveying direction. Therefore, toner falling from a portion of the intermediate transfer belt 50 located on the upstream side of the transfer nip portion 75 in the sheet conveying direction can be caught through the use of the guide plate 76. On the other hand, the guide plate 76 cannot be disposed at the transfer nip portion 75 because pressure-contact operations by the belt-side transfer roller 55, the intermediate transfer belt 50, and the sheet-side transfer roller 71 are carried out at the portion.

Thus, in this example, when the toner receiving member 82 is inserted between the intermediate transfer belt 50 and the sheet-side transfer roller 71 as illustrated in FIG. 3, a top end portion 82*a* of the toner receiving member 82 in a movement direction is disposed on the upstream side of the transfer nip portion 75 in the sheet conveying direction. Namely, the toner receiving member 82 faces the transfer nip portion 75. With this configuration, the transfer nip portion 75 in which the guide plate 76 cannot be provided, can be covered with the toner receiving member 82.

Furthermore, toner of the correction patch P1 is more likely to spatter due to centrifugal force at a curved portion R1 where the intermediate transfer belt 50 is curved with the belt-side transfer roller 55. Therefore, it is preferable that the toner receiving member 82 is moved to at least a position where the toner receiving member 82 faces the curved portion R1 of the intermediate transfer belt 50. With this configuration, a portion of the intermediate transfer belt 50 located outside the curved portion R1 in the radial direction can be covered with the toner receiving member 82, whereby it is possible to efficiently catch the toner spattering from the intermediate transfer belt 50, with the toner receiving member 82.

Note that, in this example, there has been explained an example in which the toner receiving mechanism 80 is disposed on the downstream side of the transfer nip portion 75 in the sheet conveying direction, and the toner receiving member 82 is inserted from the downstream side of the transfer nip portion 75 in the sheet conveying direction. However, the present invention is not limited to this. For example, a configuration may be such that the toner receiving mechanism 80 is disposed on the upstream side of the transfer nip portion 75 in the sheet conveying direction, and the toner receiving member 82 is inserted between the intermediate transfer belt 50 and the sheet-side transfer roller 71 from the upstream side of the transfer nip portion 75 in the sheet conveying direction.

Alternatively, a configuration may be such that the toner receiving mechanism 80 is disposed on one side of the transfer nip portion 75 in the width direction, which is perpendicular to the sheet conveying direction at the transfer nip portion 75 and perpendicular to a direction in which the sheet-side transfer roller 71 moves, and the toner receiving member 82 is inserted between the intermediate transfer belt 50 and the sheet-side transfer roller 71 from the one side of the transfer nip portion 75 in the width direction.

[Configuration of Control System]

Next, a configuration of a control system of the image forming apparatus 1 constituting the image forming system 100 will be explained with reference to FIG. 4.

FIG. 4 is a block diagram illustrating a configuration of the control system of the image forming apparatus 1 constituting the image forming system 100.

As illustrated in FIG. 4, the image forming apparatus 1 includes the control section 60, an image processing section 36, the image forming section 40, the operation display section 65, the conveying section 73, an HDD 64, the fixing section 10, the toner receiving mechanism 80, a communication section 66, and the sensor 91 for image stabilization.

The control section 60 includes, for example, a central processing unit (CPU) 61, a read only memory (ROM) 62 for storing, for example, a program the CPU 61 performs, and a random access memory (RAM) 63 used as a working area for the CPU 61. Note that a programmable ROM in which programs can be electrically deleted is used as the ROM 62.

The control section 60 is connected, via a system bus 107, to the image processing section 36, the image forming section 40, the operation display section 65, the conveying section 73, the HDD 64, the fixing section 10, the toner receiving mechanism 80, and the communication section 66, and controls the entire image forming apparatus 1. Furthermore, the control section 60 controls each section of the sheet feeding device 2 and the sheet ejection device 3 through the communication section 66. Namely, in the present embodiment, the control section 60 controls the entire image forming system 100.

Image data transmitted from the personal computer (PC) 120, showing one example of an external device connected to the image forming apparatus 1, is transmitted to the image processing section 36, and is subjected to image processing in the image processing section 36. The image processing section 36 performs image processing such as, for example, shading correction, image density adjustment, and image compression, on the received image data as necessary under control of the control section 60. Additionally, the image forming section 40 receives the image data subjected to image processing by the image processing section 36 under control of the control section 60, and forms an image on the roll sheet S on the basis of the image data.

Furthermore, the toner receiving mechanism 80 drives the toner receiver driving section 81 on the basis of control of the control section 60 to thereby control movement operation of the toner receiving member 82 (FIG. 2 and FIG. 3).

The communication section 66 serves as a communication interface for the image forming apparatus 1 to be connected to a network to which each device constituting the image forming system 100 is connected. For example, the image forming apparatus 1 performs serial communication with the sheet feeding device 2 and the sheet ejection device 3 through the communication section 66.

During image stabilizing processing, the sensor 91 for image stabilization detects a correction patch formed on the intermediate transfer belt 50. The sensor 91 for image stabilization transmits detected signals to the control section 60. Then, the control section 60 adjusts density of toners, the line width, and the dot diameter on the basis of the detected signals transmitted from the sensor 91 for image stabilization.

1-2. Operations During Image Stabilizing Processing

Next, one example of operations of the image forming apparatus 1 of the image forming system 100 having the configuration described above, during image stabilizing processing, will be explained with reference to FIGS. 5A-5C and FIG. 6.

Figure 5A:
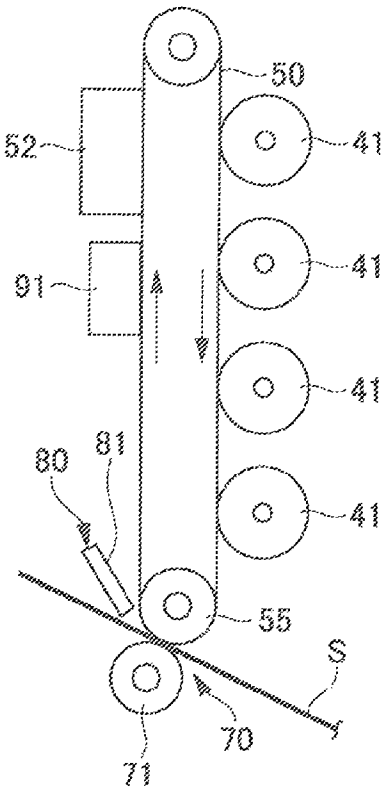
FIGS. 5A-5C illustrates operations of the image forming apparatus according to the example of the first embodiment of the present invention, during the image stabilizing processing.
Figure 5B:
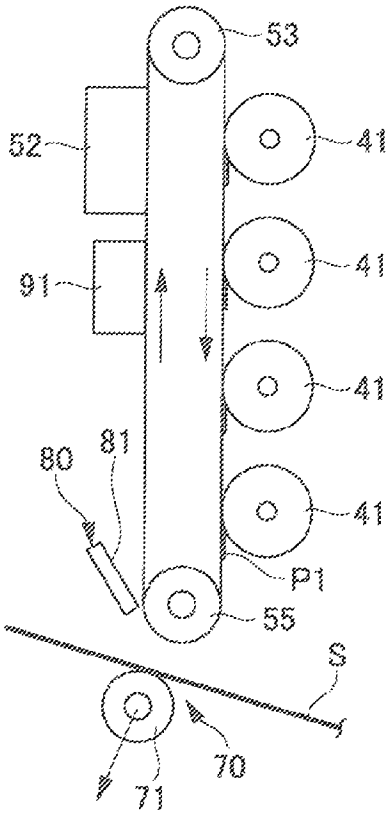
Figure 5C:
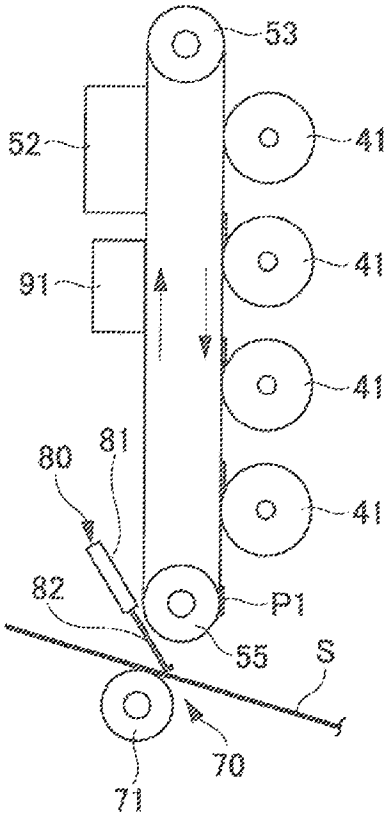
Figure 6:
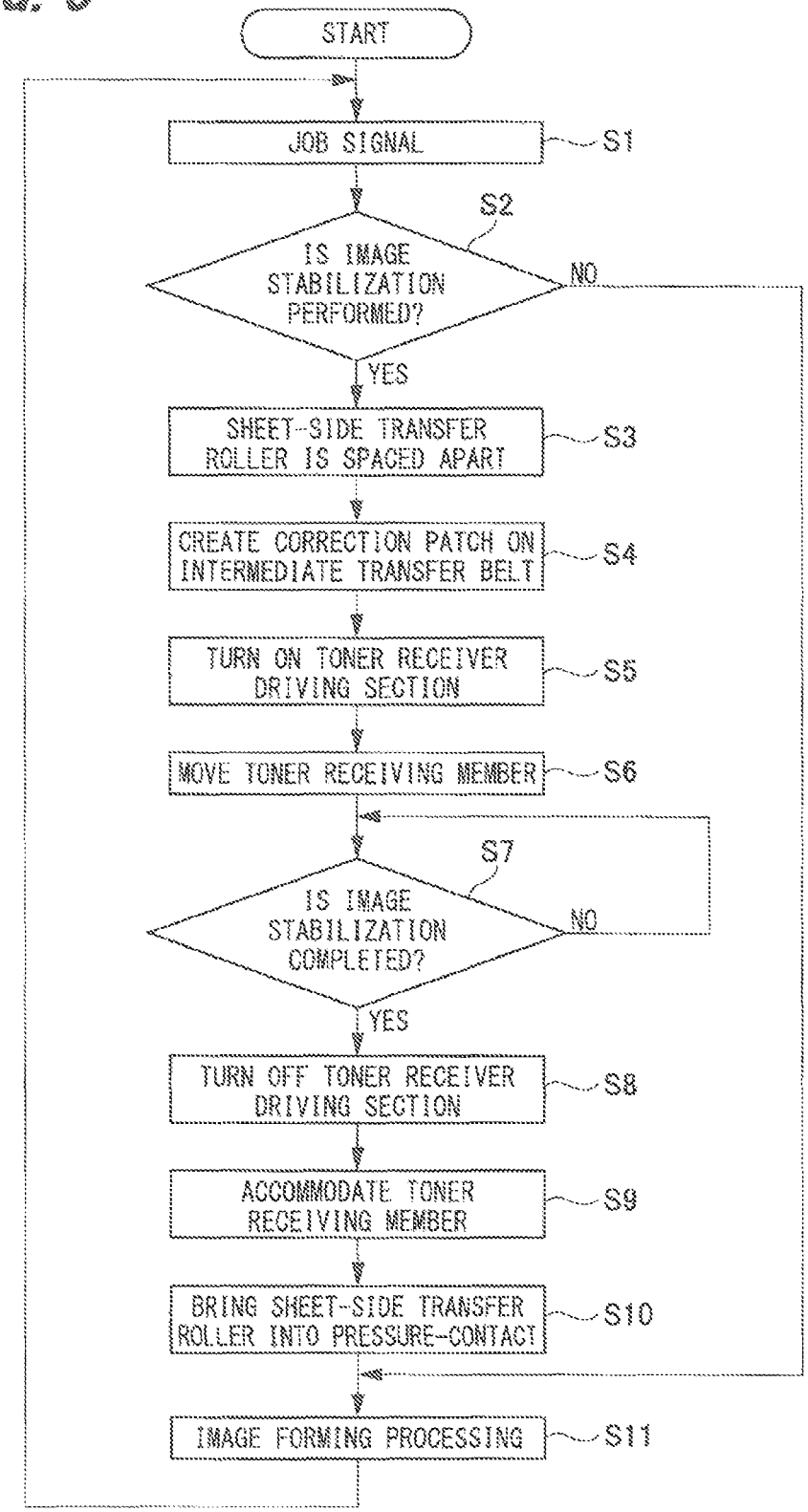
FIG. 6 is a flowchart showing operations of the image forming apparatus according to the example of the first embodiment of the present invention, during the image stabilizing processing.

FIGS. 5A-5C are an explanatory view illustrating one example of operations of the image forming apparatus 1 during image stabilizing processing, and FIG. 6 is a flowchart showing one example of operations of the image forming apparatus 1 during image stabilizing processing.

The sheet-side transfer roller 71 of the secondary transfer section 70 is brought into contact with the belt-side transfer roller 55 via the intermediate transfer belt 50, as illustrated in FIG. 5A, in a state before the start of the flow shown in FIG. 6, namely, in a state where image forming processing of forming an image on the roll sheet S is being performed. Furthermore, the toner receiving member 82 of the toner receiving mechanism 80 is accommodated in the toner receiver driving section 81, and is spaced apart from the intermediate transfer belt 50, the belt-side transfer roller 55, and the sheet-side transfer roller 71.

First, as illustrated in FIG. 6, the CPU 61 receives a JOB signal from the operation display section 65 or the personal computer 120 connected to the outside (step S1). Next, the CPU 61 determines whether or not the received JOB signal is a signal for implementing image stabilization (step S2). In addition, when the CPU 61 determines in the processing of step S2 that the JOB signal is the signal for implementing image stabilization (when determined as YES in S2), the CPU 61 causes the sheet-side transfer roller 71 to be spaced apart (step S3). Namely, as illustrated in FIG. 5B, the sheet-side transfer roller 71 is spaced apart from a portion of the intermediate transfer belt 50, in which the belt-side transfer roller 55 is placed, and thus a gap is generated between the sheet-side transfer roller 71 and the intermediate transfer belt 50.

Note that when the CPU 61 determines in the processing of step S2 that the JOB signal is not the signal for implementing image stabilization (NO in S2), the CPU 61 causes the image forming apparatus 1 to continue performing the image forming processing (step S10).

Furthermore, when the processing of step S3 is completed, the CPU 61 transmits a signal to the image forming section 40 to create a correction patch P1 on the intermediate transfer belt 50 (step S4). With this operation, the correction patch P1 including four colors of toner of yellow (Y), magenta (M), cyan (C), and black (Bk) is created on the intermediate transfer belt 50 as illustrated in FIG. 5B.

Next, the CPU 61 drives ON the toner receiver driving section 81 (step S5). In addition, the toner receiving member 82 moves by the drive of the toner receiver driving section 81 (step S6). As a result, the toner receiving member 82 is inserted between the intermediate transfer belt 50 and the sheet-side transfer roller 71 as illustrated in FIG. 5C. With this operation, the toner receiving member 82 can prevent the toner of the correction patch P1 falling from and spattering from the intermediate transfer belt 50, from adhering onto the roll sheet S or the sheet-side transfer roller 71.

Subsequently, the CPU 61 determines whether or not the image stabilizing processing is completed (step S7). Namely, in the image stabilizing processing, the sensor 91 for image stabilization detects the correction patch P1 formed on the intermediate transfer belt 50, and transmits a detection signal to the CPU 61. Then, the CPU 61 adjusts the density of toner, or line width and dot diameter on the basis of the detection signal. Furthermore, the correction patch P1 that has passed through the sensor 91 for image stabilization is removed from the intermediate transfer belt 50 through the use of the belt cleaning portion 52.

When the CPU 61 determines in the processing of step S7 that the image stabilizing processing is completed (when determined as YES in S7), the CPU 61 drives OFF the toner receiver driving section 81 (step S8). Note that, when it is determined in the processing of step S7 that the image stabilizing processing is not completed (NO in S7), the CPU 61 continues the image stabilizing processing.

Once the toner receiver driving section 81 is driven OFF in step S8, the toner receiving member 82 is spaced apart from the intermediate transfer belt 50, the belt-side transfer roller 55, and the sheet-side transfer roller 71 as illustrated in FIG. 5B, and is accommodated in the toner receiver driving section 81 (step S9).

Then, the CPU 61 brings the sheet-side transfer roller 71 closer to the belt-side transfer roller 55 side, and brings the sheet-side transfer roller 71 into pressure contact with the intermediate transfer belt 50 as illustrated in FIG. 5A (step S9). When the processing of step S9 is completed, the CPU 61 performs image forming processing (step S10).

2. Example of Second Embodiment

Next, an image forming apparatus according to an example of a second embodiment of the present invention will be explained with reference to FIG. 7 and FIG. 8.

Figure 7:
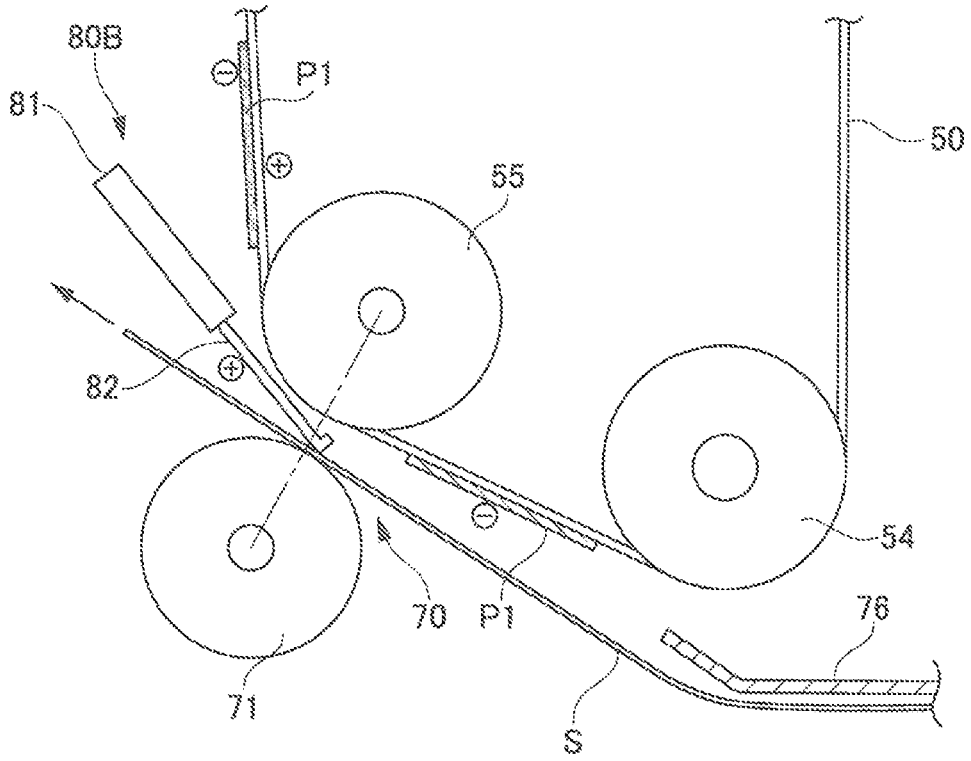
FIG. 7 is a schematic configuration diagram of an image forming apparatus according to an example of a second embodiment of the present invention, shown by enlarging a toner receiving mechanism.

FIG. 7 is a schematic configuration diagram of the image forming apparatus according to the example of the second embodiment, shown by enlarging a toner receiving mechanism. FIG. 8 is a flowchart showing an example of operations in image stabilizing processing according to the example of the second embodiment.

In this image forming apparatus according to the example of the second embodiment, an electric charge is given to the toner receiving member 82 of the toner receiving mechanism 80. Therefore, here, the toner receiving mechanism 80 will be explained, the same reference signs are attached to portions common to those of the image forming apparatus 1 according to the example of the first embodiment, and repeated explanation thereof will be omitted.

As illustrated in FIG. 7, a charge applying section, not illustrated, applies an electric charge having a polarity opposite to that of toner of the correction patch P1, to the toner receiving member 82 of a toner receiving mechanism 80B. For example, in the case where the toner has a negative polarity, an electric charge having a positive polarity is applied to the toner receiving member 82. With the configuration, it is possible to cause toner of the correction patch P1 spattering from the intermediate transfer belt 50 to adsorb onto the toner receiving member 82, whereby it becomes possible to more effectively supplement the toner.

Furthermore, the amount of electric charge applied to the toner receiving member 82 is set to be smaller than the amount of electric charge applied to the intermediate transfer belt 50. With this configuration, it is possible to prevent the correction patch P1 formed on the intermediate transfer belt 50 from being adsorbed onto the toner receiving member 82, without intention.

Note that the toner receiving member 82 is formed of a material having an electrification property.

Figure 8:
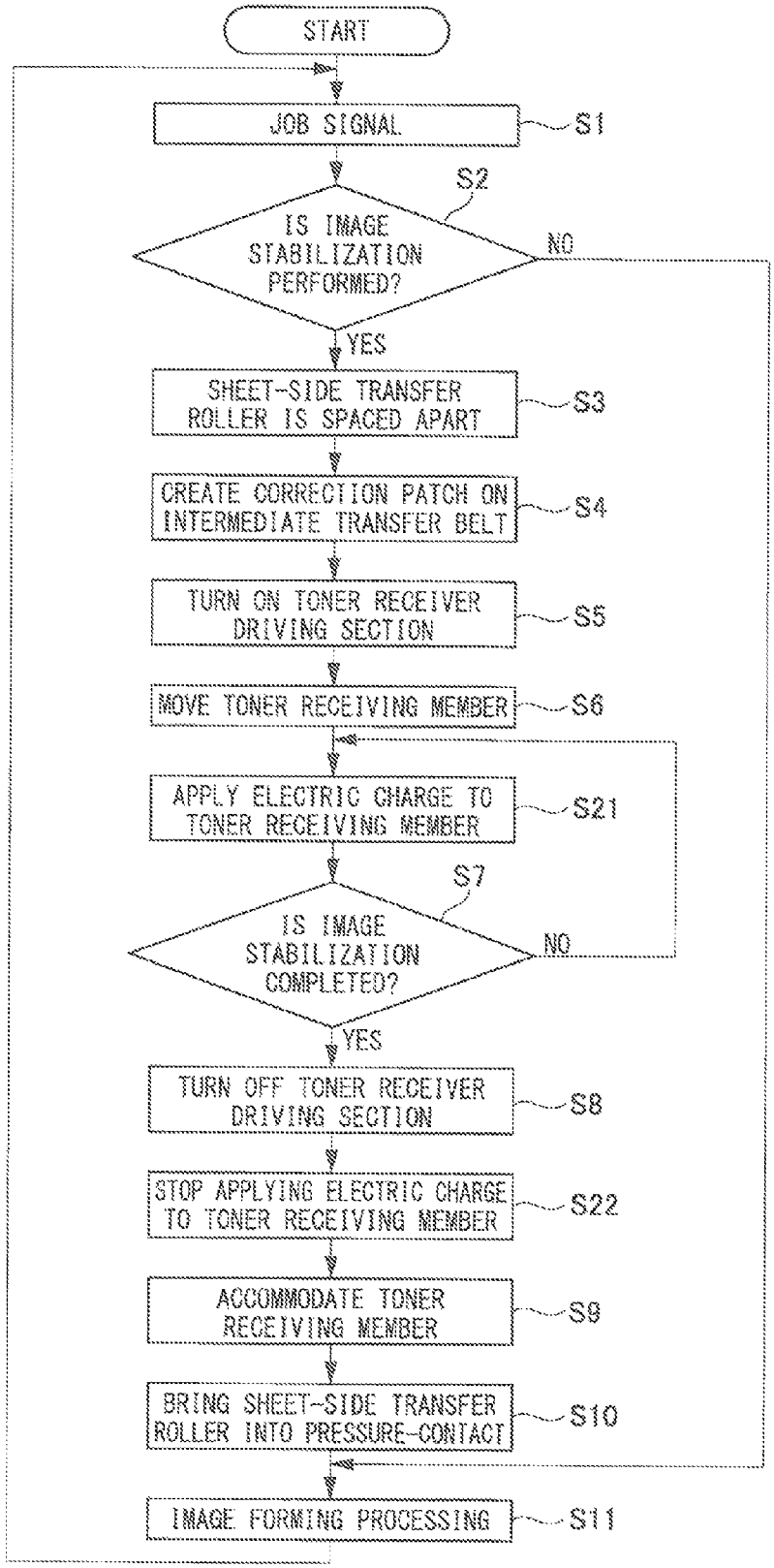
FIG. 8 is a flowchart showing operations of the image forming apparatus according to the example of the second embodiment of the present invention, during the image stabilizing processing.

In addition, in operations during image stabilizing processing, the CPU 61 applies an electric charge to the toner receiving member 82 after movement of the toner receiving member 82 is completed in step S5, as illustrated in FIG. 8 (step S21). Moreover, after the CPU 61 drives OFF the toner receiver driving section 81 in step S8, the CPU 61 stops application of an electric charge to the toner receiving member 82 (step S22). Note that other processing flows are similar to those in the image stabilizing processing according to the example of the first embodiment, and thus repeated explanation thereof will be omitted.

As described above, the power saving of the apparatus can be achieved by the configuration in which an electric charge is applied only when the toner receiving member 82 is inserted between the intermediate transfer belt 50 and the sheet-side transfer roller 71. Note that an electric charge may be applied to the toner receiving member 82 at all times.

Other configurations are similar to those of the toner receiving mechanism 80 of the image forming apparatus 1 according to the example of the first embodiment described above, and thus repeated explanation thereof will be omitted. Through the use of the toner receiving mechanism 80B having the configuration as described above, it is possible to achieve operation and effect similar to those obtained by the toner receiving mechanism 80 according to the example of the first embodiment described above.

3. Modification

Next, a modification of the image forming apparatus according to the present invention will be explained with reference to FIG. 9 to FIG. 10.

Figure 9A:
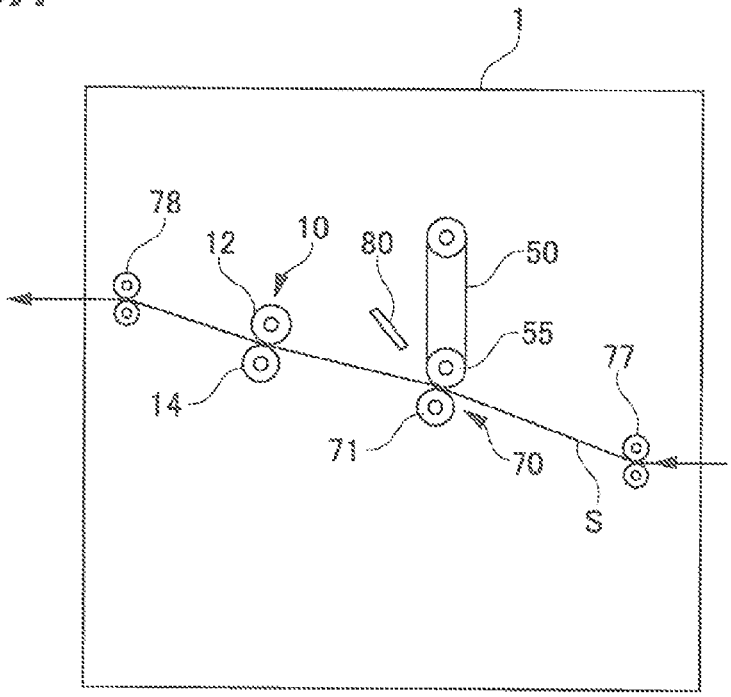
FIG. 9 A is an explanatory view schematically illustrating a state of a roll sheet during image forming processing and a normal operation.
FIG. 9B is an explanatory view schematically illustrating a state of a roll sheet during the image stabilizing processing.
Figure 9B:
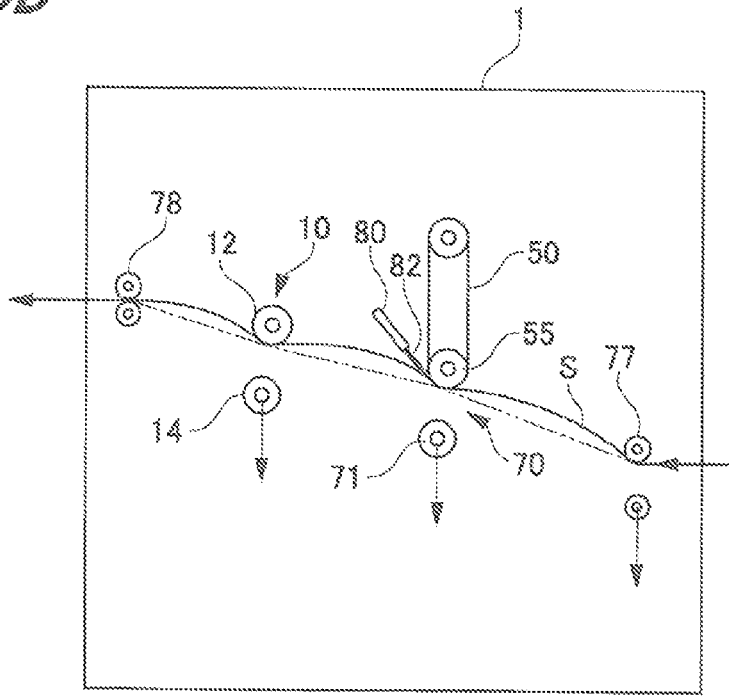

FIG. 9A and FIG. 9B are explanatory views schematically illustrating a state of a roll sheet during the image forming processing and during the image stabilizing processing. FIG. 10 is a perspective view illustrating a modification of the toner receiving member.

As illustrated in FIG. 9A, during the image forming processing, the roll sheet S continuously extends from a supply side to a ejection side within the apparatus body of the image forming apparatus 1. Furthermore, the roll sheet S is sandwiched among the conveying rollers 77 of the conveying section 73, the belt-side transfer roller 55 and the sheet-side transfer roller 71 of the secondary transfer section 70, the fixing roller 12 and the pressurizing roller 14 of the fixing section 10, and a pair of the sheet ejecting rollers 78. At this time, the roll sheet S is conveyed in a state where a certain degree of tension is applied to the sheet.

Furthermore, as illustrated in FIG. 9B, the sheet-side transfer roller 71 of the secondary transfer section 70 is spaced apart from the belt-side transfer roller 55 during image stabilizing processing, and thus the roll sheet S is deflected. In addition, the roll sheet S is brought into contact with the toner receiving member 82, by the deflection of the roll sheet S. The roll sheet S is likely to be damaged by the contact of the roll sheet S with the toner receiving member 82.

Figure 10:
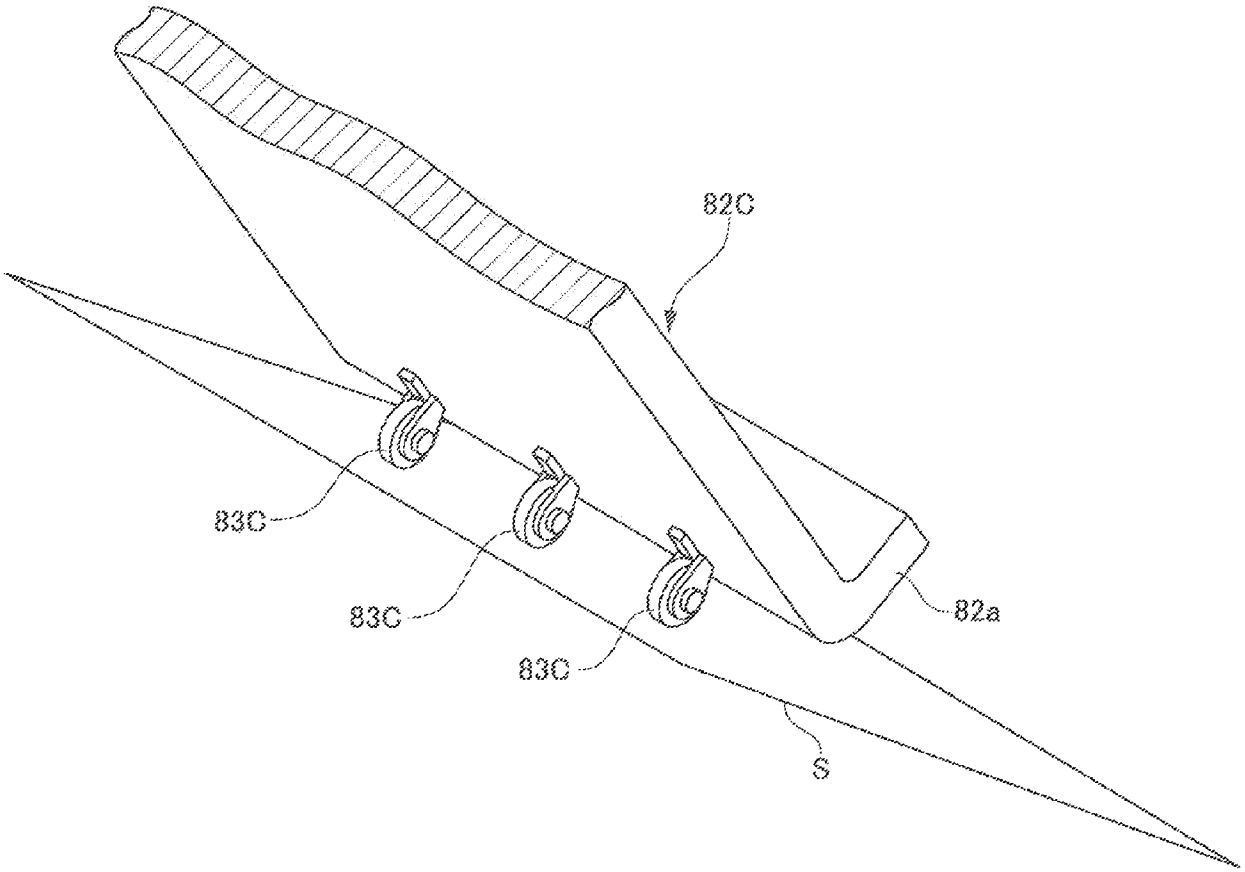
FIG. 10 is a perspective view illustrating a modification of a toner receiving member in the image forming apparatus according to the example of the first embodiment of the present invention.

For this reason, a toner receiving member 82C illustrated in FIG. 10 is rotatably provided with rollers 83*c* at the top end portion 82*a* of the toner receiving member 82C, being a portion that is in contact with the roll sheet S. With this configuration, it is possible to reduce, by using the rollers 83*c*, the load generated when the roll sheet S and the toner receiving member 82C are brought into contact with each other, whereby it becomes possible to prevent the roll sheet S from being damaged.

Note that the configuration for preventing the roll sheet S from being damaged is not limited to the rollers 83*c*. For example, it may be possible to form the top end portion 82*a* of the toner receiving member 82C into a curved shape, or use a material of the top end portion 82*a* softer than that of the roll sheet S.

4. Deflection-Removing Operation

Next, deflection-removing operations for the roll sheet S during the image stabilizing processing will be explained with reference to FIG. 11 to FIG. 12.

Figure 11:
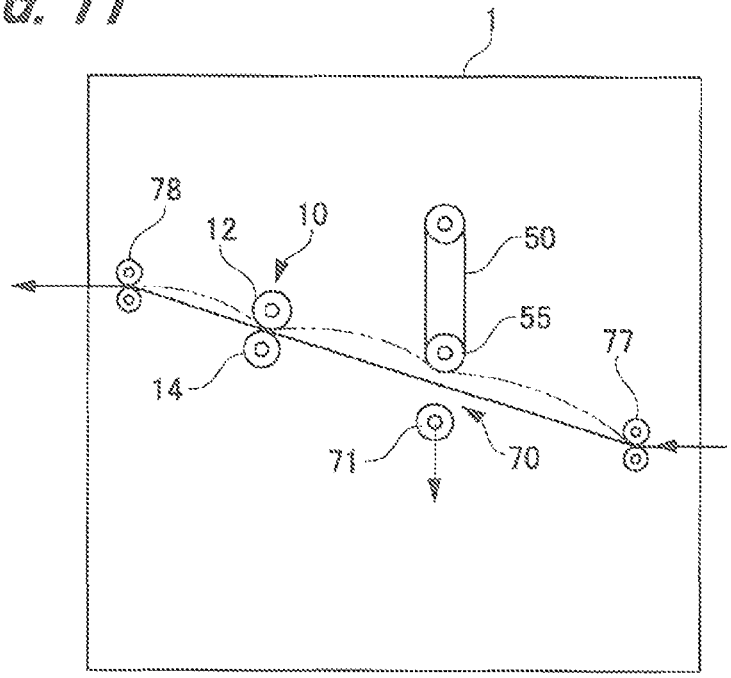
FIG. 11 is an explanatory view illustrating one example of a deflection-removing operation for a roll sheet during the image stabilizing processing.
Figure 12:
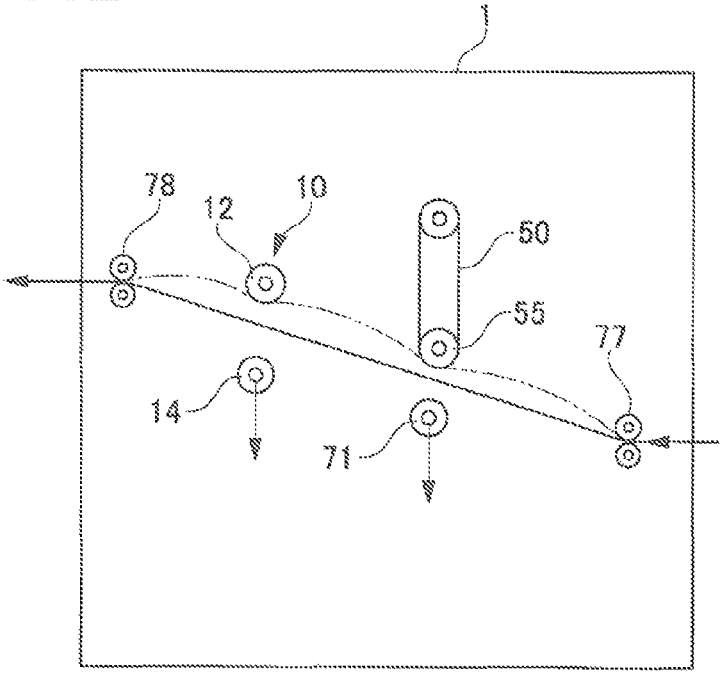
FIG. 12 is an explanatory view illustrating another example of the deflection-removing operation for the roll sheet during the image stabilizing processing.

FIG. 11 and FIG. 12 are explanatory views each illustrating a deflection-removing operation for the roll sheet S.

In the deflection-removing operation illustrated in FIG. 11, the belt-side transfer roller 55 and the sheet-side transfer roller 71 of the secondary transfer section 70 are spaced apart from each other. Furthermore, at least one pair of conveying rollers 77 among a plurality of conveying rollers 77 serving as upstream-side conveying rollers disposed on the upstream side of the secondary transfer section 70 in the sheet conveying direction are brought into pressure-contact with each other, whereby the roll sheet S is sandwiched therebetween. Moreover, the fixing roller 12 and the pressurizing roller 14 of the fixing section 10, as well as a pair of sheet ejecting rollers 78, which are disposed on the downstream side of the secondary transfer section 70 in the sheet conveying direction, are brought into pressure-contact with each other, whereby the roll sheet S is sandwiched therebetween.

In addition, the conveying speed, namely, the rotational speed of each of the fixing roller 12, the pressurizing roller 14, and the sheet ejecting rollers 78, which are disposed on the downstream side of the secondary transfer section 70 in the sheet conveying direction, is set to be faster than the rotational speed of the conveying rollers 77 disposed on the upstream side of the secondary transfer section 70 in the sheet conveying direction. With this configuration, a predetermined tension is applied to the roll sheet S, whereby it is possible to remove the deflection of the roll sheet S.

Furthermore, in FIG. 11, an example in which the fixing roller 12 and the pressurizing roller 14 of the fixing section 10, and the pair of the sheet ejecting rollers 78 are brought into pressure-contact with each other has been described, but the example is not limited to this. Namely, it is sufficient that at least one pair of rollers among a plurality of rollers serving as downstream-side conveying rollers, which are disposed on the downstream side of the secondary transfer section 70 in the sheet conveying direction, are brought into pressure-contact with each other.

In addition, in FIG. 12, the sheet ejecting rollers 78 among a plurality of rollers disposed on the downstream side of the secondary transfer section 70 in the sheet conveying direction are brought into pressure-contact with each other, and the fixing roller 12 and the pressurizing roller 14 of the fixing section 10 are spaced apart from each other. Moreover, as in FIG. 11, the rotational speed of the sheet ejecting rollers 78 disposed on the downstream side of the secondary transfer section 70 in the sheet conveying direction is set to be faster than that of the conveying rollers 77 disposed on the upstream side, whereby a predetermined tension is applied to the roll sheet S.

With this configuration, it is possible not only to remove the deflection of the roll sheet S during the image stabilizing processing, but also to suppress the generation of damage to the roll sheet S due to fixing heat in the fixing section 10.

Hereinbefore, there have been explained exemplary embodiments of the image forming apparatus, including operation and effect thereof. However, the image forming apparatus according to the present invention is not limited to the embodiments described above, and various modifications are possible without departing from the gist of the present invention specified in the scope of claims.

The exemplary embodiment described above has a configuration of forming a color image through the use of four image forming units 40Y, 40M, 40C, and 40K, but the image forming apparatus according to the present invention may have a configuration of forming a single color image through the use of one image forming section. Furthermore, the image forming apparatus is not limited to a copy machine, and a printer, a facsimile device, or a multifunction machine having a plurality of functions may be possible.

Furthermore, there has been explained an example in which the roll sheet is used as a recording medium on which images are formed, but the recording medium is not limited to this. It may be possible to use an ordinary flat paper cut into a predetermined size, as the recording medium.

In addition, in the example of the embodiment described above, there has been explained an example in which the sheet-side transfer roller is brought into contact with the intermediate transfer belt from below in the vertical direction, but the configuration is not limited to this. It may be possible to bring the sheet-side transfer roller into contact with the intermediate transfer belt from the side in the horizontal direction.

BRIEF DESCRIPTION OF THE REFERENCE SYMBOLS

1 . . . image forming apparatus, 2 . . . sheet feeding device, 3 . . . sheet ejection device, 10 . . . fixing section, 11 . . . fixing belt, 12 . . . fixing roller (downstream-side conveying roller), 13 . . . heating roller, 14 . . . pressurizing roller (downstream-side conveying roller), 50 . . . intermediate transfer belt, 52 . . . belt cleaning portion, 53 . . . driving roller, 54 . . . driven roller, 55 . . . belt-side transfer roller, 60 . . . control section, 70 . . . secondary transfer section, 71 . . . sheet-side transfer roller, 73 . . . conveying section, 75 . . . transfer nip portion, 77 . . . conveying roller (upstream-side conveying roller), 78 . . . sheet ejecting roller (downstream-side conveying roller), 80, 80B . . . toner receiving mechanism, 81 . . . toner receiver driving section, 82, 82C . . . toner receiving member, 82*a* . . . top end portion, 83*c* . . . roller, 91 . . . sensor for image stabilization, 100 . . . image forming system, S . . . roll sheet (recording medium), P1 . . . correction patch, R1 . . . curved portion

What is claimed is:

1. An image forming apparatus, comprising:

an intermediate transfer belt formed into an endless shape;

a belt-side transfer roller around which the intermediate transfer belt is stretched and which rotatably supports the intermediate transfer belt;

a sensor for image stabilization which is disposed on an upstream side of the belt-side transfer roller for the intermediate transfer belt in a rotational direction of the intermediate transfer belt, and which detects a correction patch for image stabilizing processing, the correction patch being formed on the intermediate transfer belt;

a sheet-side transfer roller that is disposed so as to face the belt-side transfer roller with the intermediate transfer belt being disposed therebetween, and is constituted so as to be able to be in contact with the intermediate transfer belt and to be spaced apart from the intermediate transfer belt;

a toner receiving member that supplements toner of the correction patch falling from and spattering from the intermediate transfer belt;

a toner receiver driving section that movably supports the toner receiving member; and a control section which causes the toner receiving member to be spaced apart from the sheet-side transfer roller and the intermediate transfer belt when the sheet-side transfer roller is brought into contact with the intermediate transfer belt, and which inserts the toner receiving member between the sheet-side transfer roller and the intermediate transfer belt when the sheet-side transfer roller is spaced apart from the intermediate transfer belt.

2. The image forming apparatus according to claim 1, wherein the toner receiving member faces a transfer nip portion at which the sheet-side transfer roller is brought into contact with the intermediate transfer belt, when the toner receiving member is inserted between the sheet-side transfer roller and the intermediate transfer belt.

3. The image forming apparatus according to claim 1, wherein the toner receiving member faces a curved portion formed on the intermediate transfer belt by the belt-side transfer roller, when the toner receiving member is inserted between the sheet-side transfer roller and the intermediate transfer belt.

4. The image forming apparatus according to claim 1, wherein the toner receiving member is formed of a member having an electrification property, the image forming apparatus further comprises a charge applying section that applies, to the toner receiving member, an electric charge having a polarity opposite to toner of the correction patch, and the charge applying section applies, to the toner receiving member, an amount of electric charge smaller than the amount of electric charge applied to the intermediate transfer belt.

5. The image forming apparatus according to claim 1, wherein a top end portion of the toner receiving member provided in a movement direction includes a roller provided in a rotatable manner.

6. The image forming apparatus according to claim 1, further comprising:

a plurality of upstream-side conveying rollers that convey a recording medium wound into a roll shape, to a transfer position of the intermediate transfer belt; and a plurality of downstream-side conveying rollers that convey the recording medium ejected from the transfer position of the intermediate transfer belt, wherein, when the sheet-side transfer roller is spaced apart from the intermediate transfer belt, the control section: brings at least one pair of upstream-side conveying rollers among the plurality of upstream-side conveying rollers into pressure-contact with each other to thereby sandwich the recording medium therebetween; brings at least one pair of downstream-side conveying rollers among the plurality of downstream-side conveying rollers into pressure-contact with each other to thereby sandwich the recording medium therebetween; and sets a conveying speed of the downstream-side conveying rollers to be faster than that of the upstream-side conveying rollers.

* * * * *